US007958876B2

(12) United States Patent
Lay

(10) Patent No.: US 7,958,876 B2
(45) Date of Patent: Jun. 14, 2011

(54) PROJECTILE EXPELLING APPARATUS

(76) Inventor: William Coleman Lay, Saint George, UT (US)

( * ) Notice: Subject to any disclaimer, the term of this patent is extended or adjusted under 35 U.S.C. 154(b) by 468 days.

(21) Appl. No.: 12/135,209

(22) Filed: Jun. 9, 2008

(65) Prior Publication Data

US 2009/0301453 A1 Dec. 10, 2009

(51) Int. Cl.
*F41B 4/00* (2006.01)

(52) U.S. Cl. ..... 124/6; 124/78

(58) Field of Classification Search ..... 124/6, 78
See application file for complete search history.

(56) References Cited

U.S. PATENT DOCUMENTS

| | | | | |
|---|---|---|---|---|
| 3,794,011 | A * | 2/1974 | Newgarden, Jr. | 124/78 |
| 4,325,351 | A * | 4/1982 | Yuasa | 124/78 |
| 4,423,717 | A * | 1/1984 | Kahelin | 124/78 |
| 4,632,088 | A | 12/1986 | Bruce | |
| 6,732,724 | B1 | 5/2004 | Paulson | |
| 6,739,325 | B1 | 5/2004 | Paulson | |
| 6,807,959 | B1 | 10/2004 | Murdock | |
| 6,863,059 | B1 | 3/2005 | Lee | |
| 6,983,741 | B2 | 1/2006 | Donald | |

* cited by examiner

*Primary Examiner* — John Ricci

(57) ABSTRACT

The present invention provides for the first time a projectile expelling apparatus having at least one fixed channel for allowing projectiles to enter at a constant entry point and a rotational expelling housing rotationally connected to at least one fixed channel for projecting projectiles at various trajectories.

21 Claims, 10 Drawing Sheets

PROJECTILE EXPELLING APPARATUS

BACKGROUND

1. Field of Invention

This invention generally relates to projectile expelling apparatuses, and more particularly, to a projectile expelling apparatus having at least one fixed channel for allowing projectiles to enter at a constant entry point and a rotational expelling housing rotationally connected to at least one fixed channel for projecting projectiles at various trajectories.

2. Description of Prior Art

In many sporting events players participate by pitching, hitting, catching, kicking, and, or, shooting a moving object. Many players purchase projectile expelling apparatuses to become better players. Some players use projectile expelling apparatuses for pitching baseballs, softballs, tennis balls, footballs, volleyballs, basketballs, and many other types of moving projectiles players play with. In addition, hunters use skeet throwers for launching projectiles to improve their shooting skills.

Many projectile expelling apparatuses expel projectiles at various types of trajectories such as straight, rising, dropping, curving, and many other variable projectile directions. To adjust the projectile trajectory, some projectile apparatuses rotate the rotational expelling housing to change the spin direction of the projectile. Changing the projectile spin direction changes the trajectory of the projectile.

Also, typical projectile expelling apparatuses usually require a second person to feed projectiles into the apparatuses; however, some projectile expelling apparatuses include an automatic projectile dispensing mechanism. These projectile dispensing mechanisms automatically dispense projectiles into the projectile expelling apparatus allowing players to practice alone.

There are many rotational projectile expelling apparatus designs that vary projectile trajectory and include a projectile dispensing mechanism. One popular design has five basic components and is configured in the following way.

First, a stand is used for stabilizing the projectile expelling apparatus on a surface. Second, a rotational housing mechanism is connected to the stand for rotating the projectile expelling housing in various rotational positions. Third, the projectile expelling housing is connected to the adjustable rotational device for allowing the projectile expelling housing to rotate for throwing various trajectory pitches. Fourth, a fixed channel feeder is connected to the projectile expelling housing as an entry chute to provide a way for projectiles to enter the expelling housing. Fifth, a projectile dispensing mechanism is fixedly attached to the fixed channel feeder.

The problem with this design is caused because the adjustable rotational device is directly connected to the projectile expelling housing, the fixed channel feeder is directly connected to the projectile expelling housing, and the projectile dispensing mechanism is fixedly attached to the fixed channel feeder. This means when the projectile expelling housing is rotated and tipped, for changing projectile trajectory, the fixed channel feeder also rotates and tips, and the projectile dispensing mechanism rotates and tips. This tipping of the projectile dispensing mechanism causes projectiles not to dispense out of the projectile dispensing mechanism properly because the angle required for using gravity to move projectile feeder to the automatic dispensing mechanism located at the fixed channel end of the projectile dispensing mechanism is changed and insufficient for proper projectile movement. Also, when the projectile dispensing mechanism is rotated and tipped, projectiles can fall out of the projectile feeder making the projectile dispensing mechanism inoperable.

One popular design for eliminating the tipping problem of the projectile dispensing mechanism is to have the fixed channel rotationally connected to the projectile expelling housing. In this way, the user can remove the projectile dispensing mechanism, rotate and tip the projectile expelling housing, rotates back and un-tip the fixed channel feeder in an upright position, and then reattaches the projectile dispensing mechanism to provide proper projectile dispensing operation. As you can see, the problem with this method is there are too many inconvenient steps involved for making this a good solution.

Another newly invented rotational projectile dispelling apparatus that varies projectile trajectory, but does not discuss attaching a projectile dispensing method, incorporates the following design structure.

First, a stand is used for stabilizing the projectile expelling apparatus on a surface. Second, a round rotational housing mechanism is connected to the stand for rotating the round fixed channel feeder. Third, the outside diameter of the round fixed channel feeder fits inside the inside diameter of the round rotational housing mechanism allowing the round fixed channel to rotate. Fourth, the projectile expelling housing is fixedly attached to the fixed channel feeder so as the fixed channel feeder rotates, so does the projectile expelling housing.

Since the fixed channel is still fixedly attached to the projectile expelling housing, the same problems discussed above occur when attaching a projectile dispensing mechanism.

OBJECTS AND ADVANTAGES

Therefore, it is an object of the invention to provide a projectile expelling apparatus having a rotational expelling housing rotationally connected to a fixed channel feeder. The rotational expelling housing adjustably rotates to vary projectile trajectory while the fixed channel feeder remains static allowing projectiles to enter the projectile expelling apparatus at the same consistent entry point each time.

It is another object of the invention to provide a fixed projectile entry point for allowing projectile dispensing mechanisms to remain in a static position for automatically dispensing projectiles into the projectile expelling apparatus.

It is another object of the invention to provide a safe and convenient way to rotate the rotational expelling housing without having to remove the projectile dispensing mechanism from the fixed channel feeder, rotate the fixed channel feeder back to its original upright position, and reattach the projectile dispensing mechanism for automatically dispensing projectiles into the projectile expelling apparatus.

It is another object of the invention to eliminate production costs by providing a simple way to automatically dispense projectiles, at different trajectories, with a rotational projectile expelling apparatus.

Further objects and advantages will become apparent from a consideration of the ensuing description and drawings.

Other features of the present invention will become apparent upon reading the following detailed description of embodiments of the invention, when taken in conjunction with the appended claims.

SUMMARY OF THE INVENTION

The present invention provides for the first time a projectile expelling apparatus having at least one fixed channel and a rotating expelling housing for expelling projectiles in various trajectories. At least one of the fixed channels has an open end and a mating end. The open end and the mating end allow projectiles to pass in and out of at least one of the fixed channels.

The rotational expelling housing includes a rotational channel and at least one projectile expelling mechanism. The rotational channel has an entry end and an exit end. The entry end and the exit end allow projectiles to pass in and out of the rotational channel. The rotational channel and at least one of the fixed channels are aligned at an axis of rotation to create a concentric mating point. This concentric mating point allows projectiles to enter and exit the fixed channel and enter and exit the rotational channel when the rotational expelling housing is rotated to any position. At least one projectile expelling mechanism is attached to the rotational expelling housing for expelling projectiles.

BRIEF DESCRIPTION OF THE DRAWINGS

A complete understanding of the present invention may be obtained by reference to the accompany drawings, when considered in conjunction with the subsequent, detailed description.

For purposes of clarity, brevity, like elements and components will bear the same designations and numbering throughout the figures.

REFERENCE NUMERALS

| | |
|---|---|
| 20 projectile expelling apparatus | 22 channel base |
| 24 fixed channel | 26 open end |
| 28 mating end | 30 hollow axis of rotation |
| 34 channel support | 35 tri-pod base |
| 36 rotational expelling housing | 38 rotational channel |
| 40 entry end | 42 exit end |
| 44 void axis of rotation | 50 projectile expelling mechanism |
| 51 expelling member | 52 concentric mating point |
| 53 force member | 54 rotational direction |
| 55 push member | 56 wheel |
| 57 frame member | 58 rotational arm |
| 60 pneumatic device | 62 rotational locking mechanism |
| 64 channel adapter | 65 rotation arc |
| 66 pivot and lock mechanism | 67 pivot knob |
| 68 up and down pivot direction | 72 projectile dispensing mechanism |
| 74 projectile feeder | 76 automatic dispenser |
| 78 feeding end | 80 timing device |
| 82 gate | |

PREFERRED EMBODIMENT—DESCRIPTION

Figure 1:
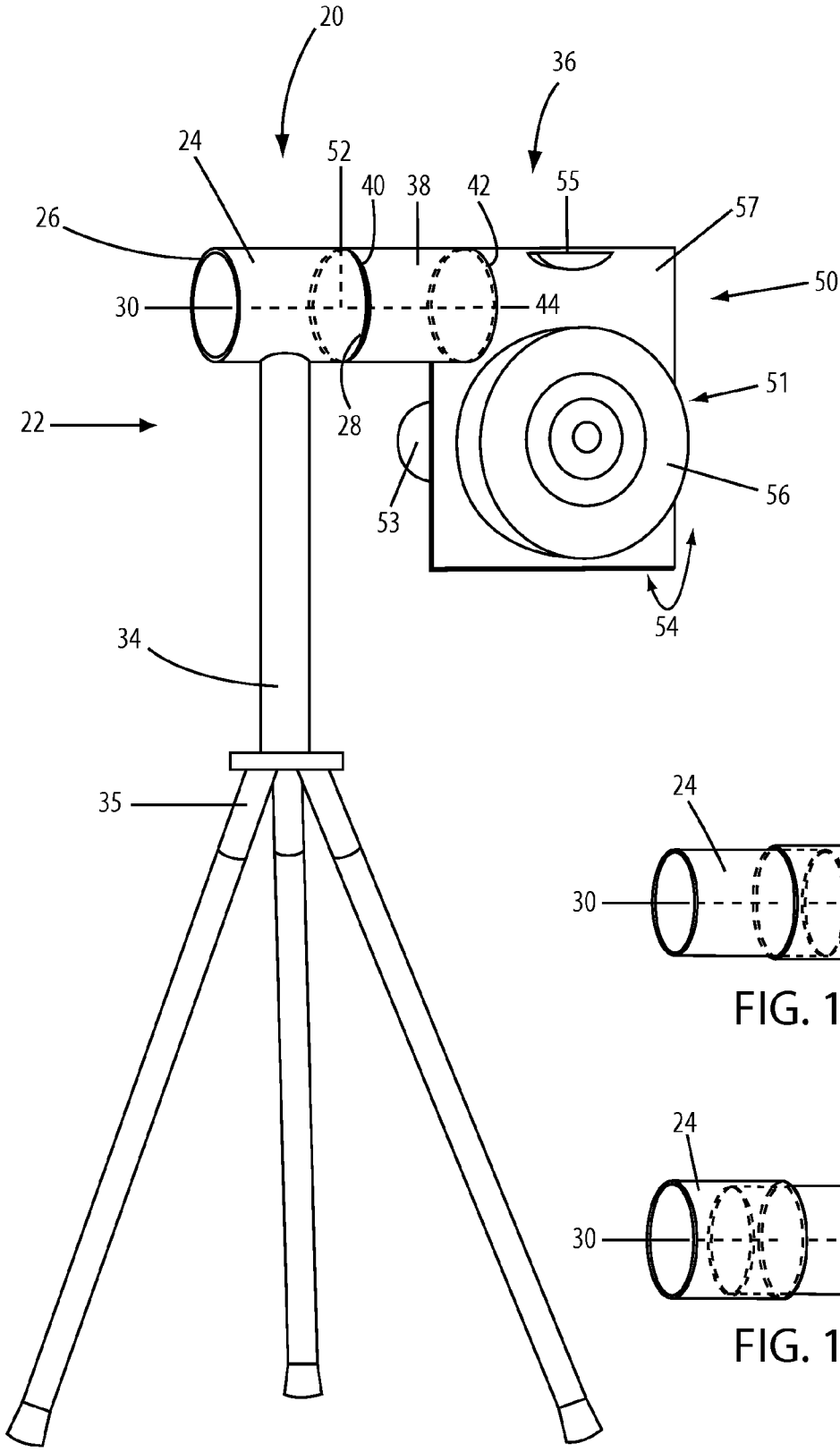
FIG. 1 is a perspective view of the preferred embodiment of the projectile expelling apparatus with a channel base and a rotational expelling housing.

FIG. 1 illustrates a projectile expelling apparatus 20, comprising at least one channel base 22 and a rotational expelling housing 36. The rotational expelling housing 36 rotates in a rotational direction 54 and includes a rotational channel 38 and a projectile expelling mechanism 50. The projectile expelling mechanism 50 includes a frame member 57, a push member 55, an expelling member 51, and a force member 53.

The channel base 22 includes at least one fixed channel 24. The fixed channel 24 has an open end 26 and a mating end 28. The open end 26 and the mating end 28 are formed to allow projectiles to pass in and out of at least one of the fixed channels 24. At least one of the fixed channels 24 has a hollow axis of rotation 30 located approximately at the center of at least one of the fixed channels 24. At least one channel support 34 is connected to at least one of the fixed channels 24 for supporting at least one of the fixed channels 24 in a stable position.

To fabricate the fixed channel 24, metal, plastic, aluminum, or any material strong enough to sustain the weight of projectiles and also support the mounting of the rotational expelling housing 36 can be used. The fixed channel 24 can be flat, round, square, triangular, u-shaped, or any other shape for allowing projectiles to move along the fixed channel 24. The fixed channel 24 can be as small as 0.010" in length or as long as 50' in length. The width can also be any size as long as projectiles can move along the fixed channel 24 in an aligned manner. The hollow axis of rotation 30 is approximately located in the center of the fixed channel 24 and is hollow to allow projectiles to move along the fixed channel 24 and also to provide the rotational expelling housing 36 a concentric mating point of rotation 52.

To fabricate the channel support 34, any material size, type, and shape can be used as long as the channel support 34 supports the fixed channel 24 in a stable position. To connect the channel support 34 to the fixed channel 24, gluing, molding, welding, bolting, screwing, sliding, or any other means available can be used to permanently or temporarily join the fixed channel 24 to the channel support 34. The channel support 34 can further include a tri-pod base 35 for added stability.

The rotational expelling housing 36 rotates in a rotational direction 54 and includes a rotational channel 38 and a projectile expelling mechanism 50. The rotational channel 38 includes an entry end 40 and an exit end 42. The entry end 40 and the exit end 42 are formed to allow projectiles to pass in and out of the rotational channel 38. The rotational channel 38 has a void axis of rotation 44 located approximately at the center of the rotational channel 36. The void axis of rotation 44 aligns with the hollow axis of rotation 30 of at least one of the fixed channels 24. At least one of the fixed channels 24 and the rotational channel 38 rotationally connect creating a concentric mating point 52 for allowing projectiles to enter and exit at least one of the fixed channels 24 and enter and exit the rotational channel 38 when the rotational expelling housing 36 is rotated to any position.

The rotational channel 38 can be formed from metal, plastic, wood, or any material suitable for supporting projectiles. The rotational channel 38 can be flat, round, square, triangular, u-shaped, or any other shape for allowing projectiles to move along the rotational channel 38 as long as a void axis of rotation 44 can be established. The rotational channel 38 can be as small as 0.010" in length or as long as 50' in length. The width can also be any size as long as projectiles can move along the rotational channel 38.

Figure 1A:
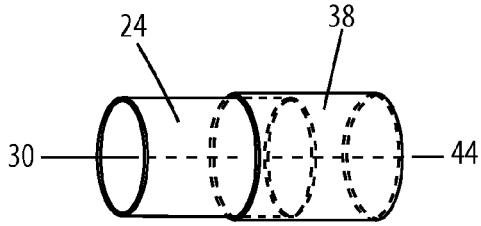
Figure 1B:
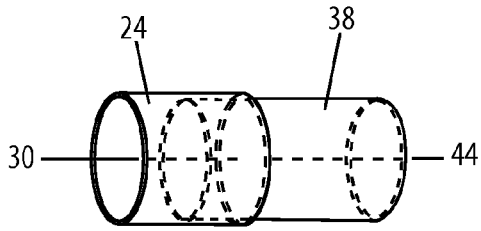

FIG. 1A shows the hollow axis of rotation 30 and the void axis of rotation 44 mating by sliding the fixed channel 24 into the rotational channel 38. FIG. 1B shows the hollow axis of rotation 30 and the void axis of rotation 44 mating by sliding the rotational channel 38 into the fixed channel 24. These are just two possible assembly methods available for use.

The rotational channel 38 is securely connected to the projectile expelling mechanism 50 and as stated, includes a frame member 57, a pinch member 55, a force member 53, and an expelling member 51. Projectiles move from the fixed channel 24, to the rotational channel 38, and then to the projectile expelling mechanism 50.

The frame member 57 of the projectile expelling mechanism 50 rigidly connects to the rotational channel 38 and supports the mounting of the push member 55 and the force member 53. The frame member 57 can be fabricated from flat steel plate, steel tubing, molded plastic, or other rigid materials strong enough for mounting and strong enough to withstand the required forces needed to expel projectiles.

The push member 55 is securely connected to the frame member 57 for pushing projectiles into the expelling member 51. This pushing force allows the expelling member 51 to grip projectiles for expulsion. The push member 55 can be made of soft materials such at polyurethane or hard materials such as steel tubing or plastic. The push member 55 can be adjusted up and down for adjusting the push distance for use with variable sized projectiles.

The force member 53 is securely connected to the frame member 57 for applying rotational force to the expelling member 51. The force member 53 is rigidly mounted to the frame member 57 and can include an AC Motor, DC Motor, or any type of motion device capable of applying the necessary forces required to put the expelling member 51 in motion.

The force member 53 is rigidly attached to the expelling member 51. The expelling member 51 rotates to expel projectiles at various trajectories and uses at least one wheel 56 to expel projectiles. The wheel size can be of any diameter from 0.125" to 48", the wheel width can measure 0.125" to 24", and the wheel type can be pneumatic, solid, molded, or any other wheel type sufficient for expelling projectiles. The overall wheel configuration can be as small as 0.125" in diameter for portability or as large as 48" for added expelling velocity.

ALTERNATIVE EMBODIMENTS—DESCRIPTION

Figure 2:
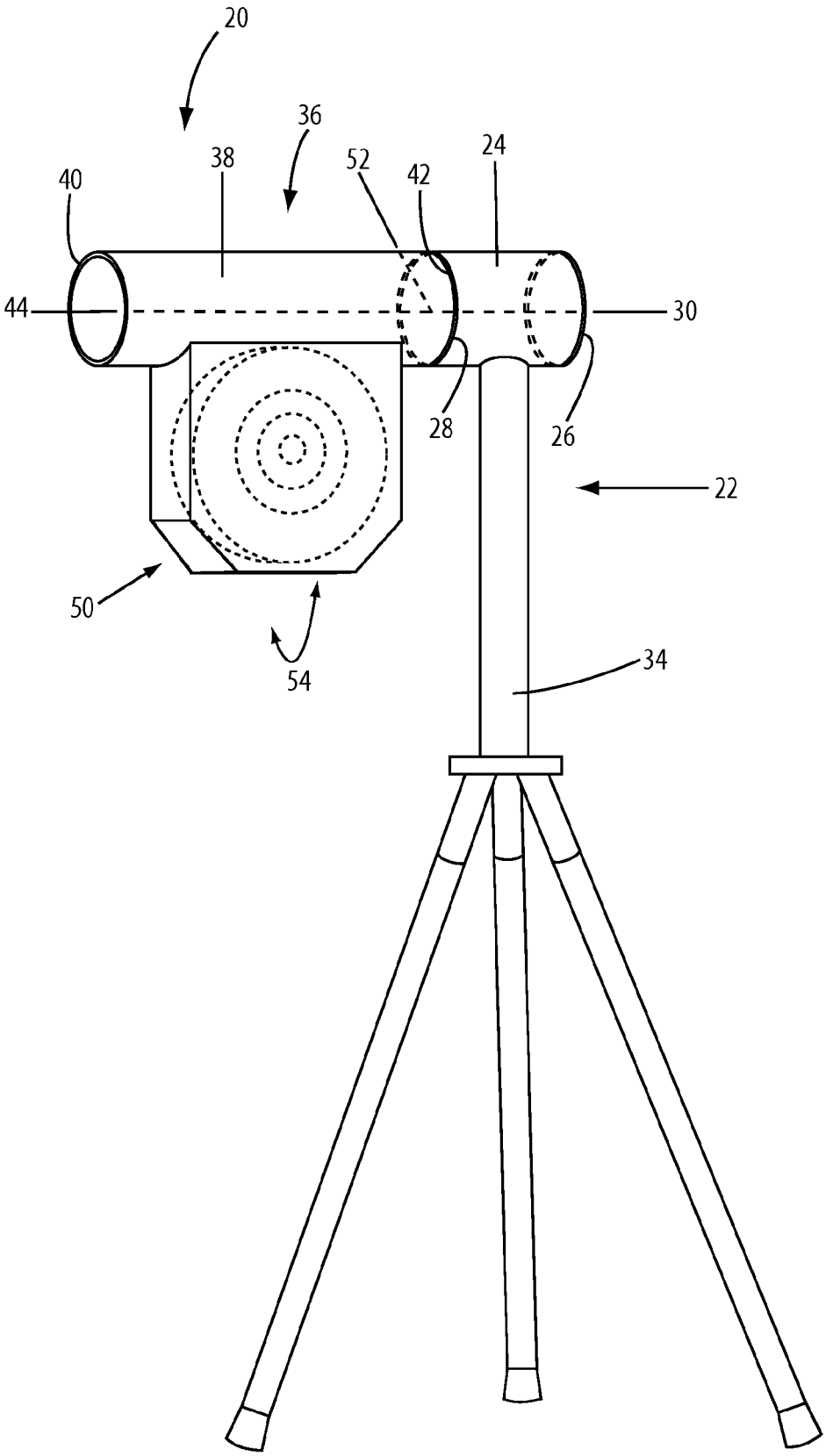
FIG. 2 is a perspective view of an alternative embodiment of the projectile expelling apparatus showing an alternative method for rotationally connecting the channel base to the rotational expelling housing.

In FIG. 2, the mating end 28 of at least one of the fixed channels 24 is rotationally connected to the exit end 42 of the rotational channel 38. The hollow axis of rotation 30 and the void axis of rotation 44 are approximately aligned to create a concentric mating point 52 for allowing projectiles to enter and exit the rotational channel 38 and enter and exit the fixed channel 24 when the rotational expelling housing 36 is rotated to any position.

Figure 3:
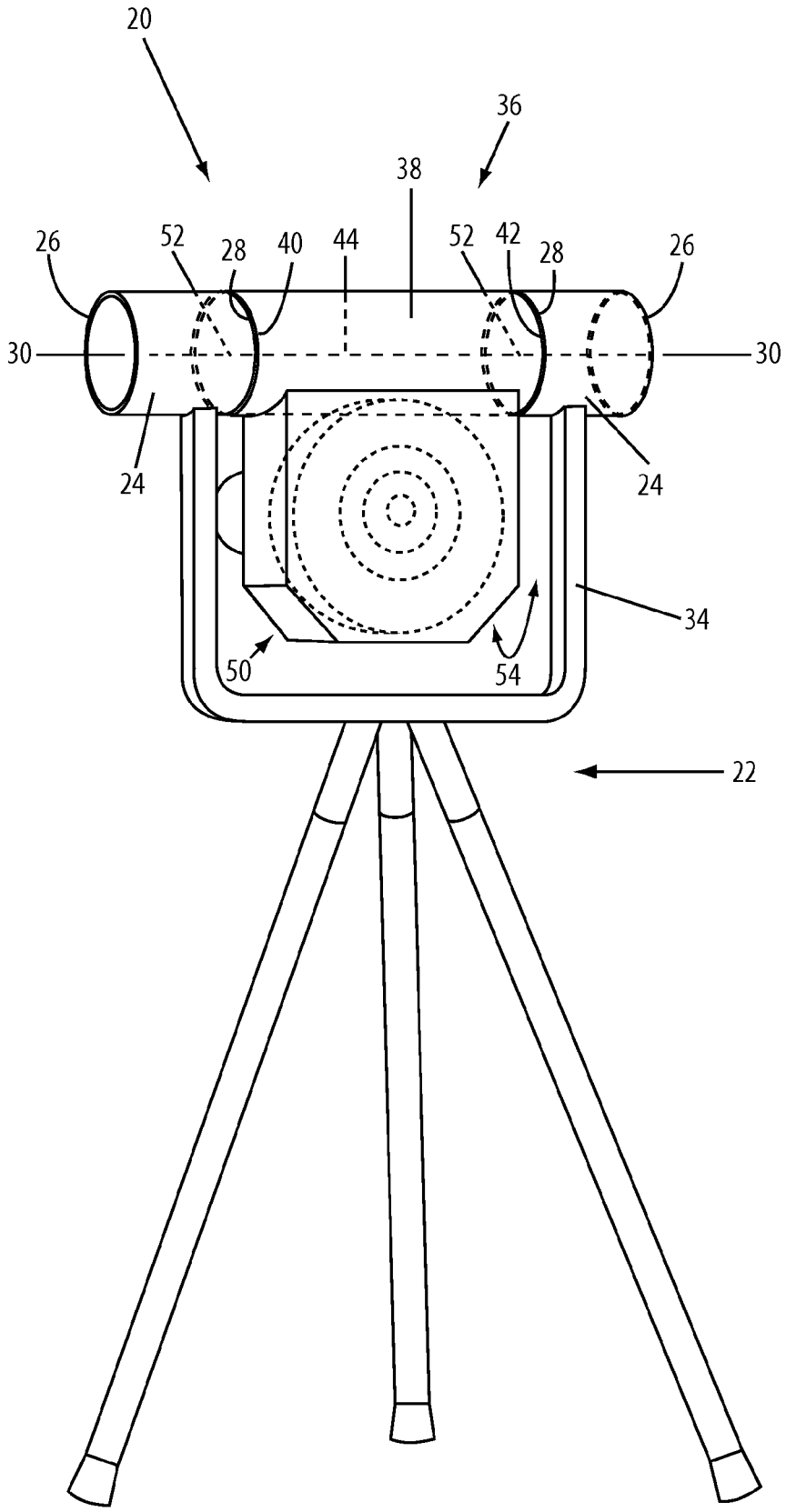
FIG. 3 is a perspective view of another alternative embodiment of the projectile expelling apparatus showing another alternative method for rotationally connecting the channel base to the rotational expelling housing.

In FIG. 3, the mating end 28 of at least one of the fixed channels 24 is rotationally connected to the entry end 40 of the rotational channel 38. The hollow axis of rotation 30 and the void axis of rotation 44 are approximately aligned to create a concentric mating point 52 for allowing projectiles to enter and exit the fixed channel 24 and enter the rotational expelling housing 36. The mating end 28 of at least one of the fixed channels 24 is rotationally connected to the exit end 42 of the rotational channel 38. The hollow axis of rotation 30 and the void axis of rotation 44 are approximately aligned to create a concentric mating point 52 for allowing projectiles to exit the rotational channel 38 and the fixed channel 24 when the rotational expelling housing 36 is rotated to any position.

Figure 4:
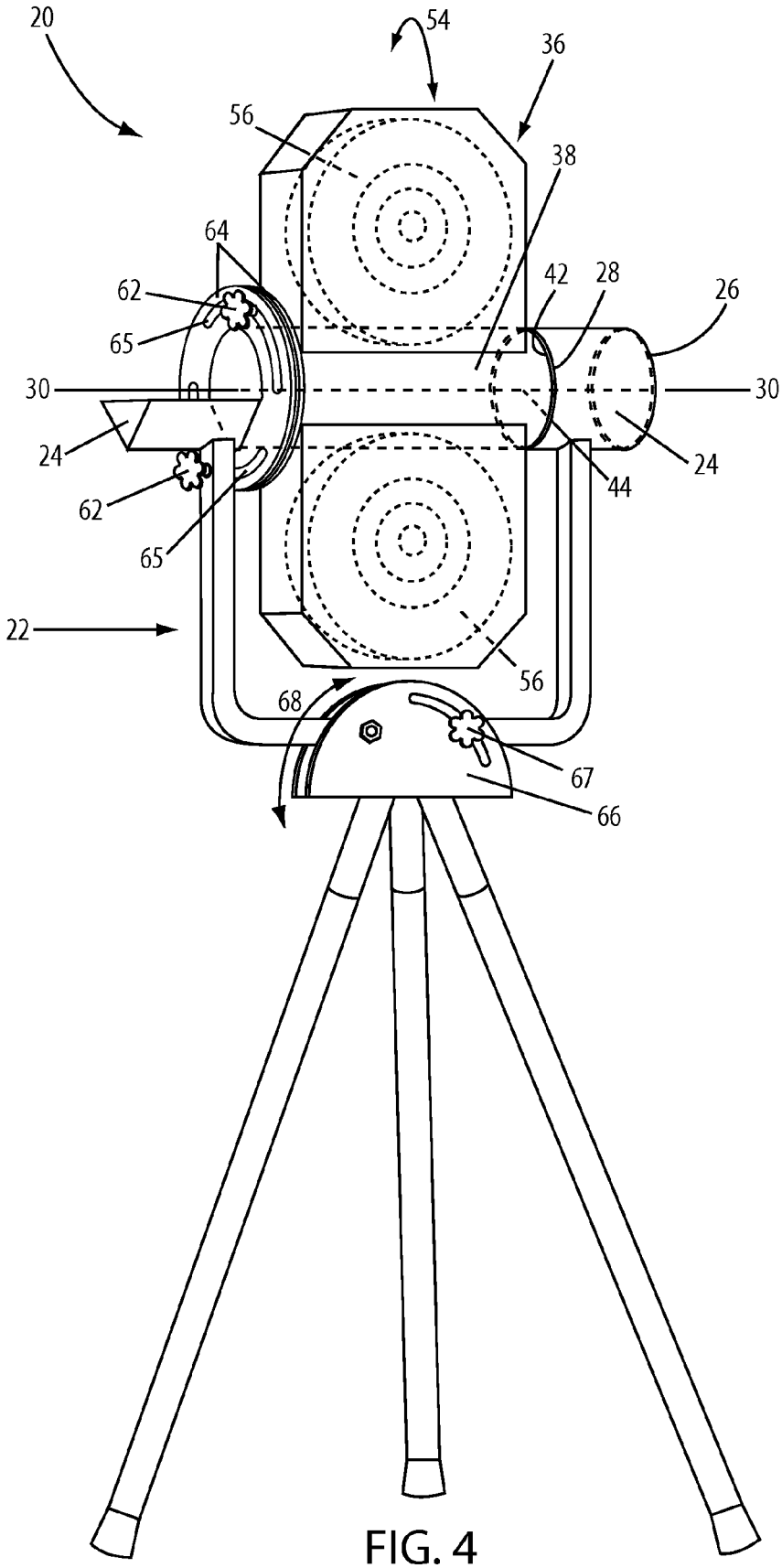
FIG. 4 is a perspective view of an alternative embodiment of the projectile expelling apparatus showing a rotational locking method, a channel adapter, and a pivot and lock mechanism for making various rotational and pivotal adjustments to the projectile expelling apparatus.

In FIG. 4, a rotational locking mechanism 62 is formed for locking the rotational direction 54 of the rotational expelling housing 36. The rotational locking mechanism 62 adjacently connects to the channel base 22. The rotational locking mechanism 62 can be a bolt, knob, pin, clamp, bracket, or any type of device suitable for locking the rotational direction 54 of the rotational expelling housing 36. The material for the rotational locking mechanism 62 can be plastic, steel, aluminum, or any material of sufficient locking strength.

Two channel adapters 64 are formed to maintain the alignment of the hollow axis of rotation 30 and the void axis of rotation 44. Each channel adapter 64 can be used to mate various shapes and sizes of fixed channels 24 to various shapes and sizes of rotational channels 38. Each channel adapter 64 can be made of metal, plastic, aluminum, or any material of sufficient strength. Each channel adapter 64 is made from 0.187" steel plate and has a rotation arc 65 following the void axis of rotation 44 of the rotational channel 38 and the hollow axis of rotation 30.

One channel adapter 64 is welded to the rotational expelling housing 36 and one channel adapter 64 is welded to the channel base 22 to concentrically align at least one of the fixed channels 24 with the rotational channel 38. Two rotational locking mechanisms 62 secure the two channel adapters 64 rotationally together, allowing the fixed channel 22 to remain fixed and the rotational channel 38 to rotate. The two rotational locking mechanisms 62 create a rotational connection by sliding in the rotation arc 65 of the channel adapter 64.

A pivot and lock mechanism 66 is formed to pivot and secure the rotational expelling housing 36 in an up and down pivot direction 68 for varying projectile travel height. The pivot and lock mechanism 66 can be made of steel, plastic, aluminum, wood, or any other material suitable for supporting the rotational expelling housing 36. A pivot knob 67 can be made out of a bolt, pin, nut, or any other mechanism for securing the pivot direction 68 of the pivot and lock mechanism 66.

Figure 5:
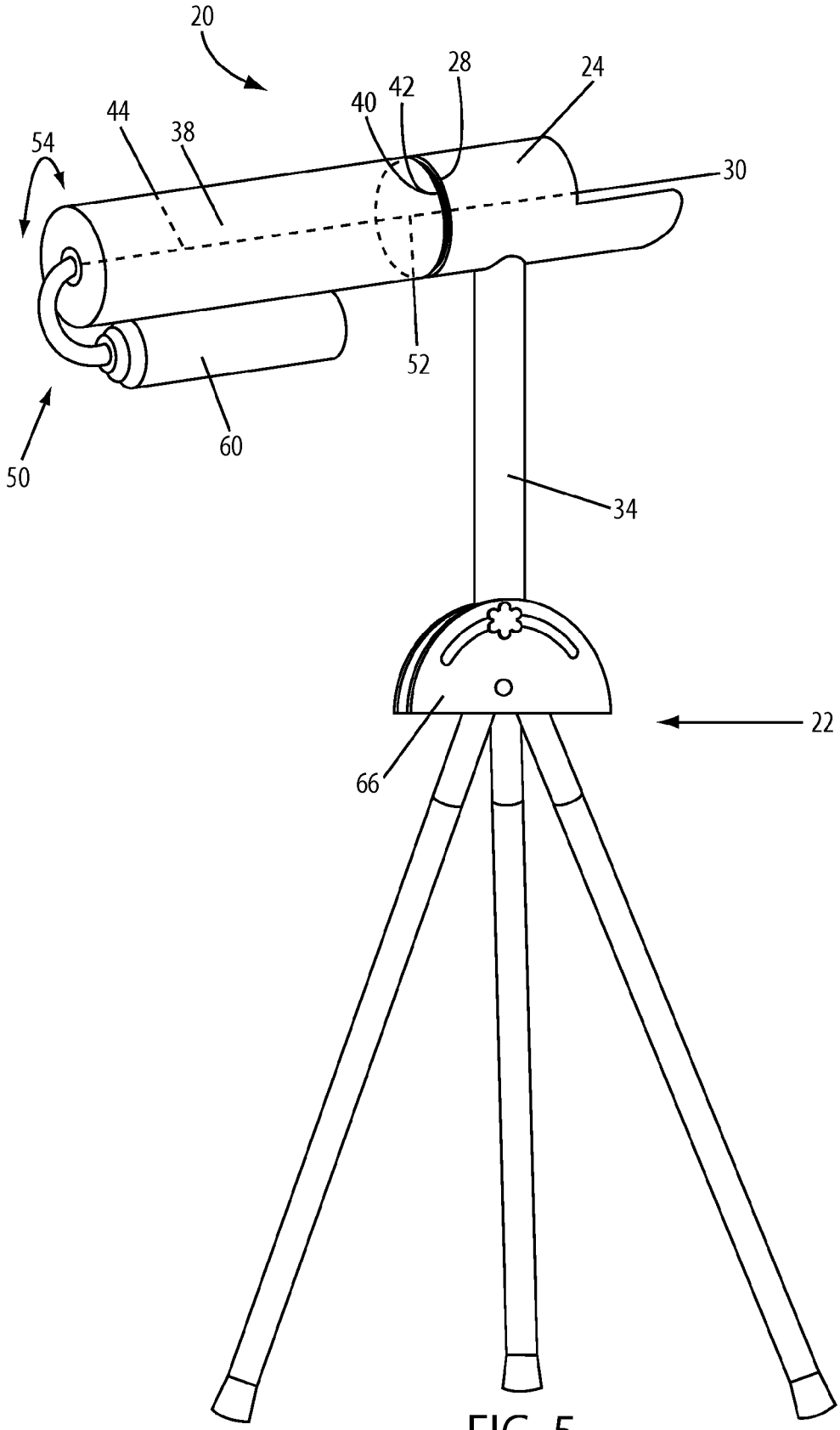
FIG. 5 is a perspective view of an alternative embodiment of the projectile expelling apparatus showing an alternative method for expelling projectiles with at least one pneumatic device.

In FIG. 5, the mating end 28 of at least one of the fixed channels 24 is rotationally connected to the entry end 40 and the exit end 42 of the rotational channel 38. The hollow axis of rotation 30 and the void axis of rotation 44 are approximately aligned to create a concentric mating point 52 for allowing projectiles to enter and exit the fixed channel 24 and enter and exit the rotational expelling housing 36 when the rotational expelling housing 36 is rotated to any position.

The projectile expelling mechanism 50 uses at least one pneumatic device 60 to expel projectiles. The pneumatic device 60 can use compressed air, gas, or any other material suitable for expelling projectiles with pneumatics. At least one of the fixed channels 24 is angled to allow gravity to move projectiles along at least one of the fixed channels 24 and the rotational channel 38 is angled to allow gravity to move projectiles along the rotational channel 38.

Figure 6:
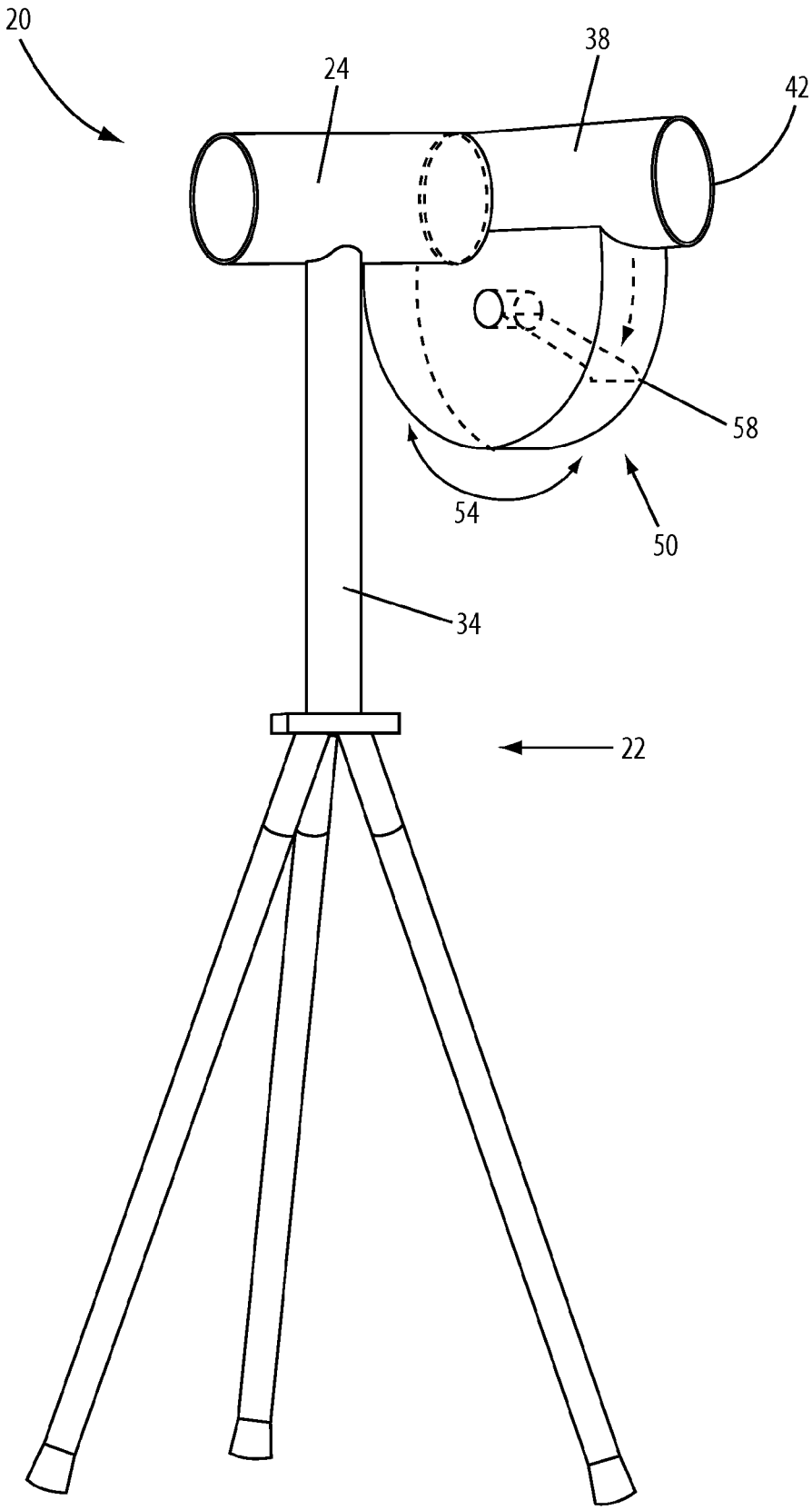
FIG. 6 is a perspective view of an alternative embodiment of the projectile expelling apparatus showing an alternative method for expelling projectiles with at least one rotational arm.

In FIG. 6, the projectile expelling mechanism 50 uses at least one rotational arm 58 to expel projectiles. The rotational arm 58 can be made of metal, plastic, rubber, or any material sufficient for launching a projectile. The rotational arm length can vary depending on the desired projectile velocity, the longer the rotational arm 58, the faster the maximum velocity. The arm width can be of any size as long as projectiles can be supported.

Figure 7:
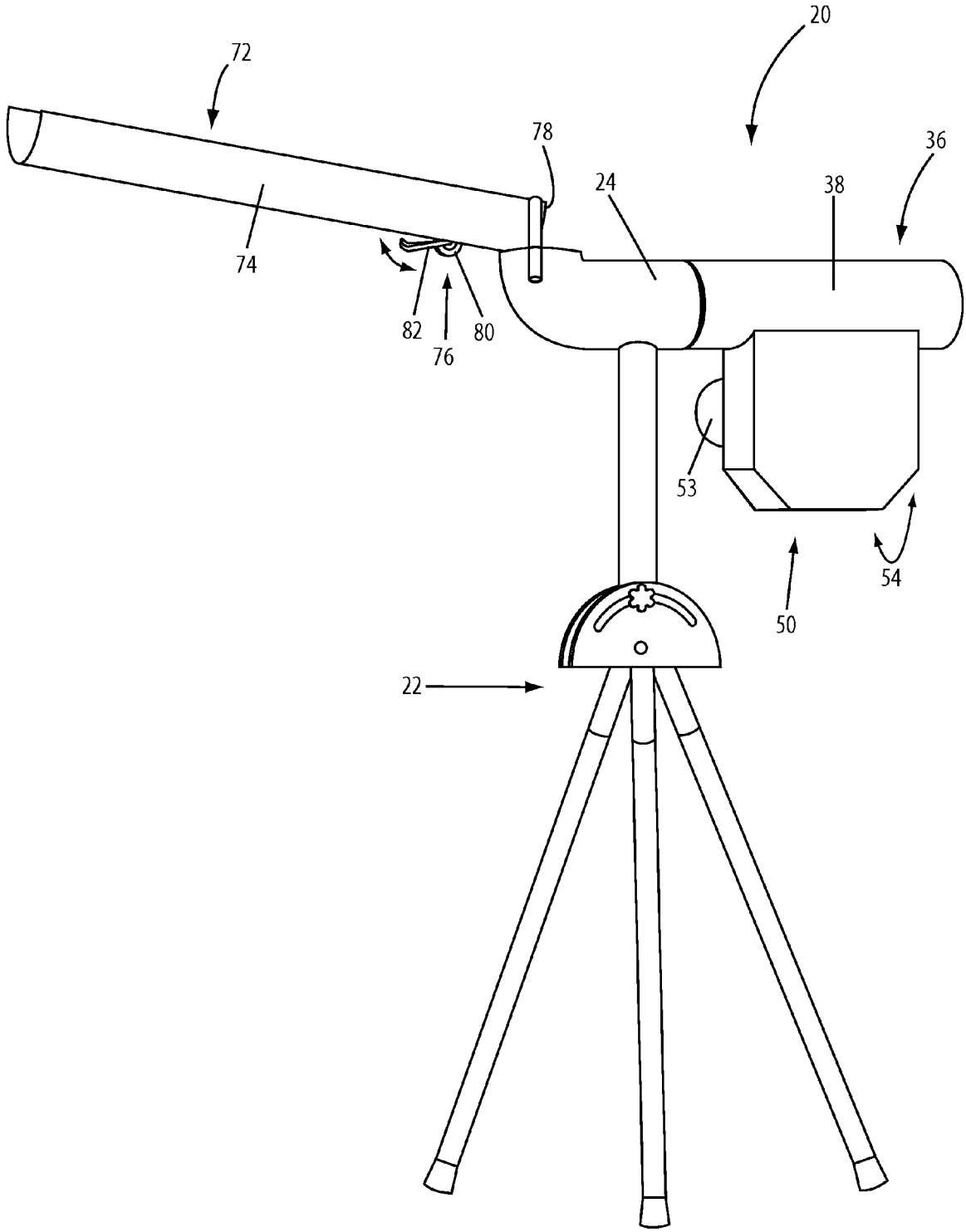
FIG. 7 is a perspective view of an alternative embodiment of the projectile expelling apparatus showing an attachable projectile dispensing mechanism.

In FIG. 7, a projectile dispensing mechanism 72 is adjacently located to at least one of the fixed channels 24. The projectile dispensing mechanism 72 includes a projectile feeder 74 and an automatic dispenser 76. The automatic dispenser 76 is formed to dispense projectiles into at least one of the fixed channels 24. The projectile feeder 74 is formed to contain and feed projectiles into the automatic dispenser 76. The automatic dispenser 76 is positively connected to the feeding end 78 of the projectile feeder 74.

Figure 8:
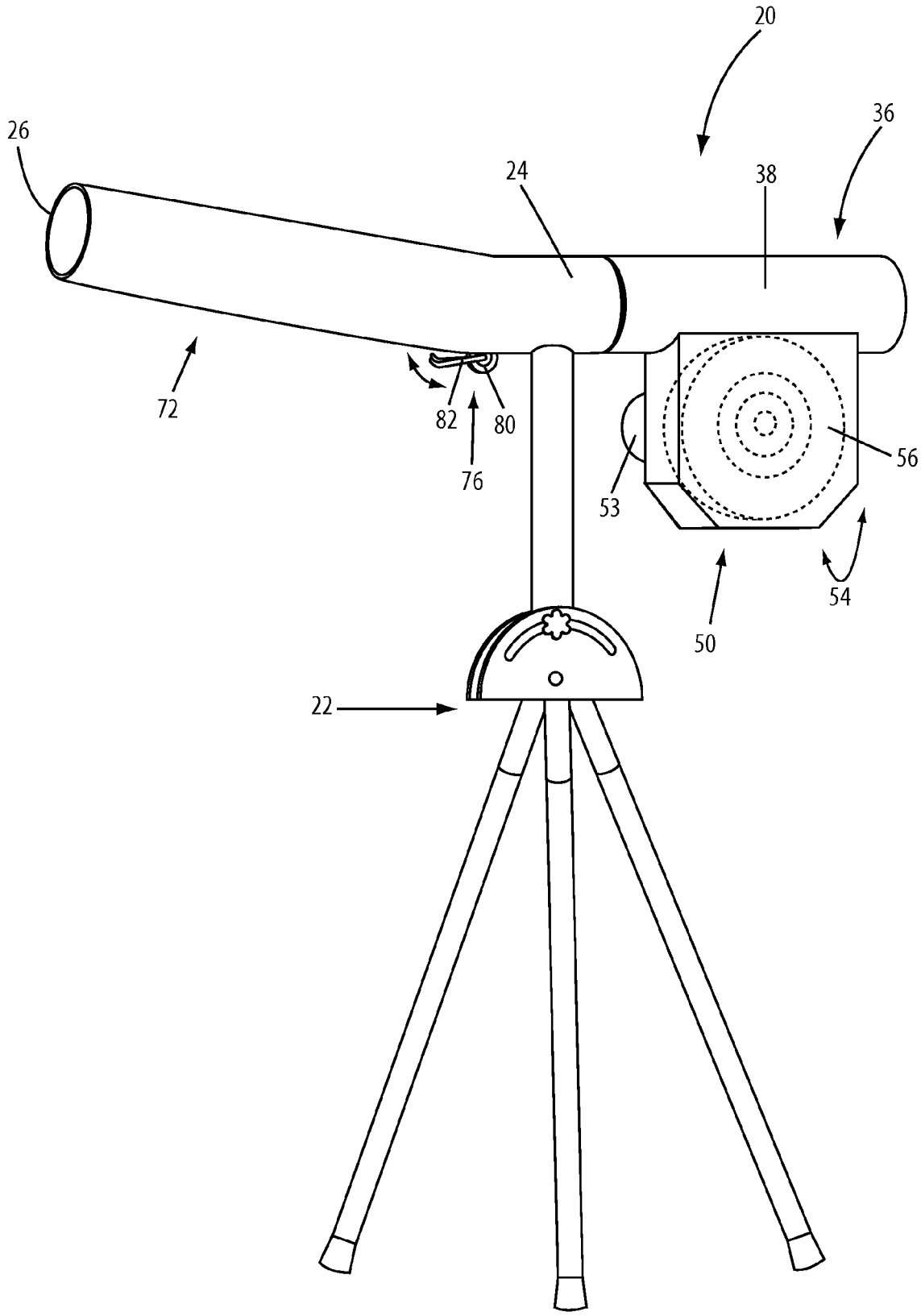
FIG. 8 is a perspective view of an alternative embodiment of the projectile expelling apparatus showing an automatic dispenser securely attached to the fixed channel.

In FIG. 8, the automatic dispenser 76 is directly attached to at least one of the fixed channels 24 by mounting the automatic dispenser 76 directly to the fixed channel 24. The automatic dispenser 76 can be attached to the fixed channel 24 by welding, gluing, bolting, or any other successful attachment method. The automatic dispenser 76 includes a timing device 80 and a gate 82. The timing device 80 moves the gate 82 to automatically release projectiles into the fixed channel 24. The timing device 80 includes a motor, mechanical timer, or any other automated operating device capable of moving the gate 82. The gate 82 can be a roller, a rotational arm, or any other type of device capable of releasing projectiles at timed intervals. The gate 82 dispenses projectiles past the gate and into the fixed channel 24.

Figure 9:
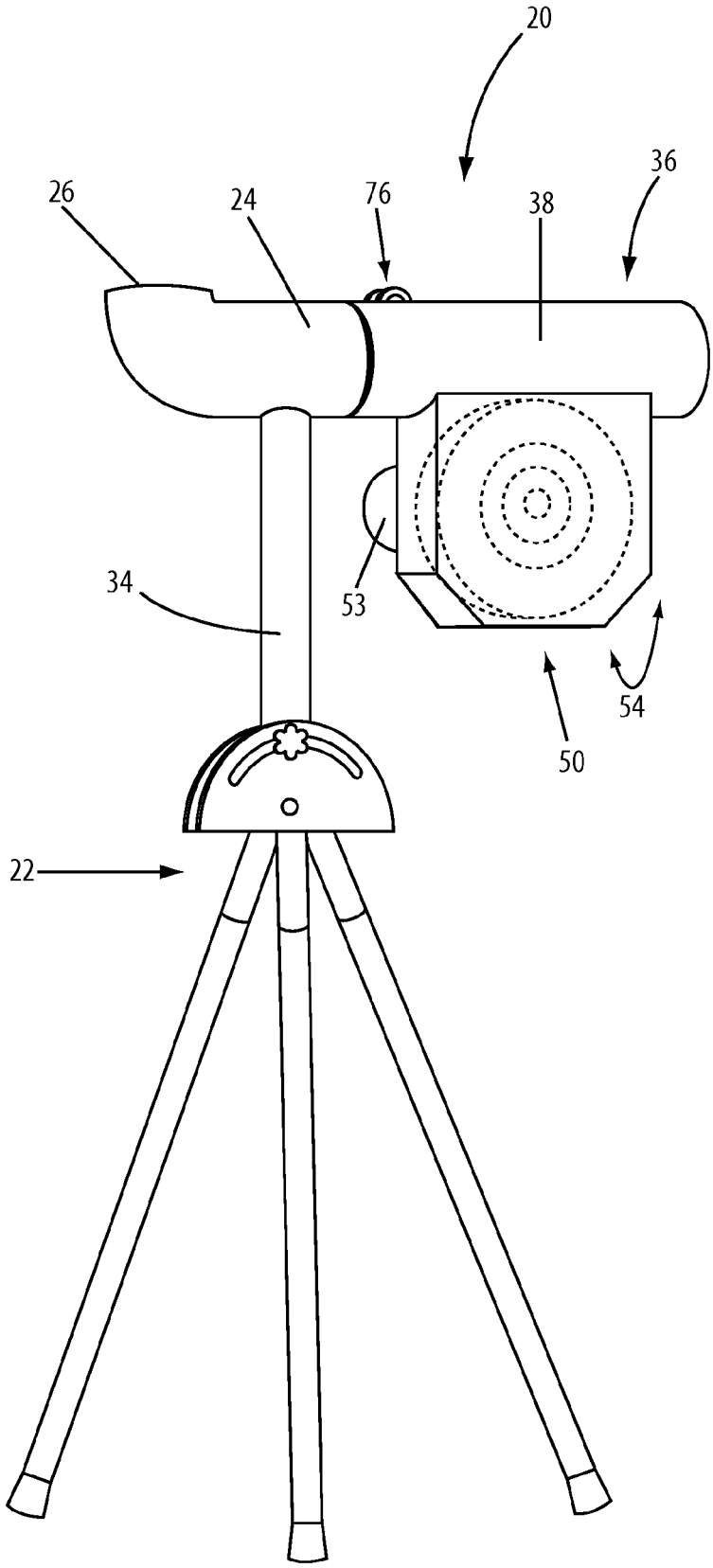
FIG. 9 is a perspective view of an alternative embodiment of the projectile expelling apparatus showing an automatic dispenser securely attached to the rotational expelling housing.

In FIG. 9, the automatic dispenser 76 is directly attached to the rotational expelling housing 36. The automatic dispenser 76 can be attached to the rotational expelling housing 36 by welding, gluing, bolting, or by any other successful attachment method.

Figure 10:
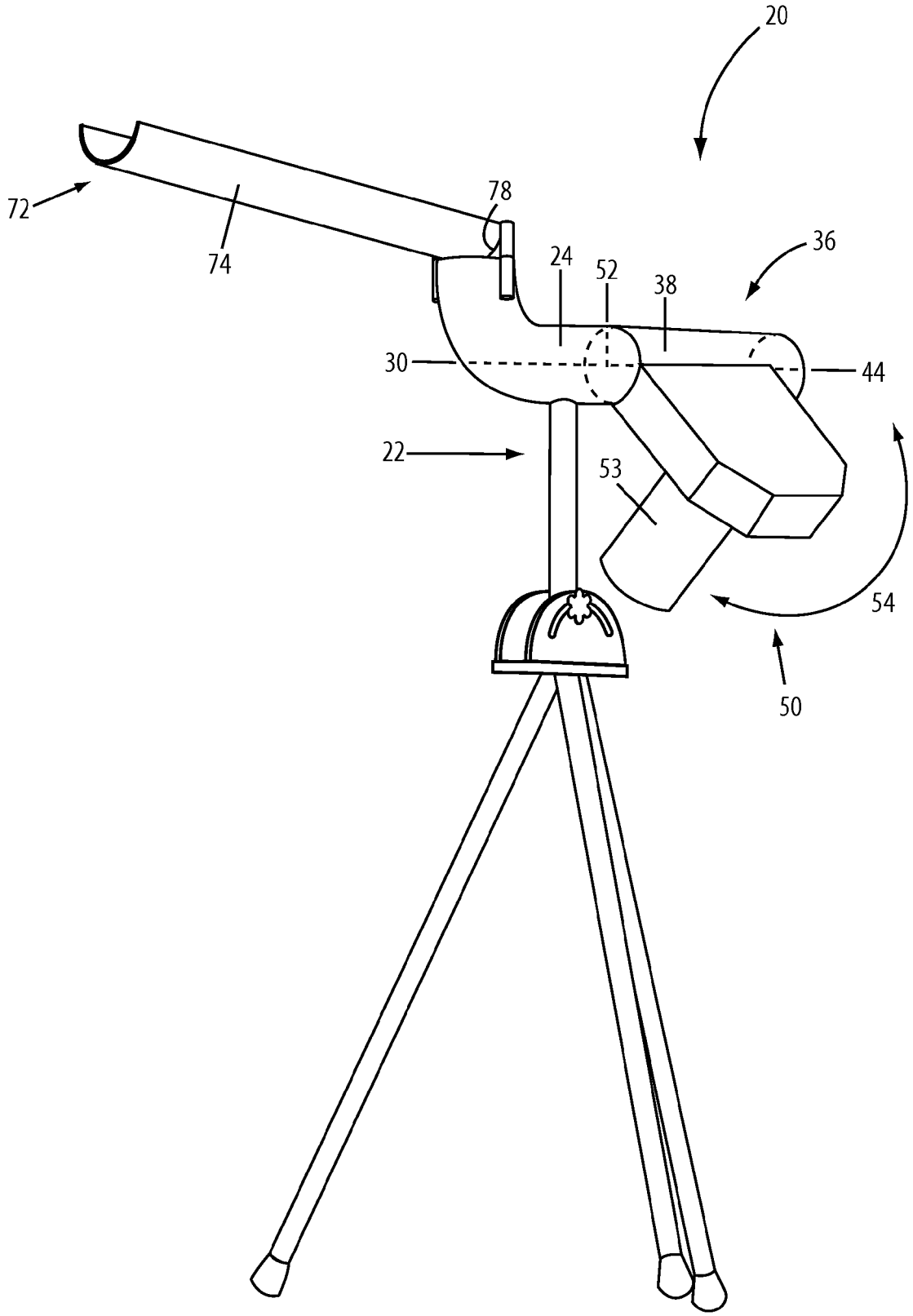
FIG. 10 is a perspective view showing the rotational direction of the projectile expelling apparatus.

FIG. 10 shows the rotational direction 54 of the rotational expelling housing 36 with the attached projectile dispelling mechanism 72. The void axis of rotation 44 of the rotational expelling housing 36 rotationally connects with the hollow axis of rotation 30 of the fixed channel 24 to create a concentric mating point 52 for rotating the rotational expelling housing 36 in a 360-degree circumference.

PREFERRED EMBODIMENT—OPERATION

To utilize the new projectile expelling apparatus 20, FIG. 1 shows the rotational expelling housing 36 rotationally connected to the channel base 22 as aforementioned.

The channel base 22 is disposed on a surface for stabilizing the rotational expelling housing 36. The channel base 22 includes a tri-pod base 35 for added surface stability and a channel support 34 for supporting the fixed channel 24 in a fixed position.

To begin operating the projectile expelling apparatus 20, a projectile is fed into the open end 26 of the fixed channel 24 and moves along the fixed channel 24 until exiting the mating end 28. The projectile then enters the entry end 40 of the rotational channel 38 and departs the exit end 42 of the rotational channel 38 thereby entering the projectile expelling mechanism 50. The frame member 57 rigidly aligns the push member 55 and the expelling mechanism 50 causing the projectile to be compressed into the expelling member 51. This compression allows the expelling member 51 to create a gripping action on the projectile for expelling the projectile out of the rotational expelling housing 36. In this embodiment, the expelling member 51 is a wheel 56. A force member 53 is used to powerfully rotate the wheel 56 providing the energy necessary to expel the projectile from the rotational expelling housing 36. Since the push member 55 remains fixed and the wheel 56 rotates forward, a backspin is put on the projectile. This rotational backspin causes the projectile to expel in a straight trajectory.

To change the projectile trajectory and make the projectile curve, the user simply rotates the rotational expelling housing 36 in the rotational direction 54 for changing the rotational position of the rotational expelling housing 36. When the rotational direction 54 of the rotational expelling housing 36 is rotated, the fixed channel 24 remains stationary allowing projectiles to enter the projectile expelling apparatus 20 at a constant, non-rotating, entry point. For example, to pitch an inside breaking curveball, the rotational expelling housing 36 would be rotated and positioned at a 45 degrees position causing the ball to spin at a 45 degree rotation. This 45-degree rotation causes the projectile to curve in an in and down direction. To change the pitch trajectory again, simply change the projectile spin direction by rotating the rotational expelling housing 36 to a different rotational position.

ALTERNATIVE EMBODIMENTS—OPERATION

FIG. 2 shows an alternative embodiment for operating the projectile expelling apparatus 20. To begin, the projectile is fed into the entry end 40 of the rotational channel 38 and engages the projectile expelling mechanism 50. The projectile is then compressed between the rotational channel 38 and the projectile expelling mechanism 50 causing the projectile to be compressed. This compression allows the projectile expelling mechanism 50 to create a gripping action on the projectile for expelling the projectile out the exit end 42 of the rotational channel 38. The projectile then enters the mating end 28 of the fixed channel 24 and expels from the open end 26 of the fixed channel 24.

To change the trajectory of the projectile, simply change the rotational position of the rotational expelling housing 36 by rotating the rotational expelling housing 36 in the rotational direction 54. When the rotational direction 54 of the rotational expelling housing 36 is rotated, the fixed channel 24 remains stationary allowing projectiles to enter the projectile expelling apparatus 20 at a constant, non-rotating, entry point.

FIG. 3 shows another alternative embodiment for operating the projectile expelling apparatus 20. To begin operating the projectile expelling apparatus 20, a projectile is fed into the open end 26 of the fixed channel 24 and moves along the fixed channel 24 until exiting the mating end 28. The projectile is then fed into the entry end 40 of the rotational channel 38 and engages the projectile expelling mechanism 50. The projectile is then compressed between the rotational channel 38 and the projectile expelling mechanism 50 causing the projectile to be compressed. This compression allows the projectile expelling mechanism 50 to create a gripping action on the projectile for expelling the projectile out the exit end 42 of the rotational channel 38. The projectile then enters the mating end 28 of another fixed channel 24 and expels from the open end 26 of another of the fixed channels 24.

To change the trajectory of the projectile, simply change the rotational position of the rotational expelling housing 36 by rotating the rotational expelling housing 36 in the rotational direction 54. When the rotational direction 54 of the rotational expelling housing 36 is rotated, the fixed channels 24 remain stationary allowing projectiles to enter the projectile expelling apparatus 20 at a constant, non-rotating entry point.

FIG. 4 shows another alternative embodiment for making various adjustments to the projectile expelling apparatus 20. To begin operating the projectile expelling apparatus 20, a projectile is fed into the fixed channel 24. The projectile then moves past the fixed channel 24 and then past the channel adapter 64 until entering the rotational channel 38. The projectile is then compressed between two rotational wheels 56 causing the projectile to be compressed. This compression of the two wheels 56 creates a gripping action on the projectile and expels the projectile out the exit end 42 of the rotational channel 38. The projectile then enters the mating end 28 of another fixed channel 24 and expels out the open end 26 of another of the fixed channels 24.

To change the trajectory of the projectile, simply adjust the rotational position of the rotational expelling housing 36 by loosening the rotational locking mechanism 62 and sliding the rotational locking mechanism in the rotation arcs 65. This rotates the rotational expelling housing 36 in the rotational direction 54. When the rotational direction 54 of the rotational expelling housing 36 is rotated, tighten the rotational locking mechanism 62 to secure the rotational position. The fixed channels 24 remain stationary allowing projectiles to enter the projectile expelling apparatus 20 at a constant, non-rotating, entry point.

To change the directional height of the projectile, simply pivot the channel base 22 in the pivot and lock mechanism 66. By pivoting the channel base 22 in an up and down pivot direction 68 and securing the pivot position in a set position by tightening the pivot knob 67 the projectile delivery height can be higher or lower based on the users preference.

FIG. 5 shows another alternative embodiment of the projectile expelling apparatus 20 using a pneumatic device 60 for expelling projectiles. To begin operating the projectile expelling apparatus 20, a projectile is fed into the fixed channel 24 and passes the mating end 28. The projectile then enters the rotational channel 38 by passing the entry end 40 and the exit end 42 and then moves down to rest at the end of the rotational channel 38. The projectile expelling mechanism 50 is then engaged using a pneumatic device 60, such as compressed air, to expel the projectile down the rotational channel 38, past the entry end 40, past the exit end 42, and past the mating end 28 to be projected out of the fixed channel 24.

To change the trajectory of the projectile, simply change the rotational position of the rotational channel 38 by rotating the rotational channel 38 in the rotational direction 54. When the rotational channel 38 is rotated, the fixed channel 24 remains stationary allowing projectiles to enter the projectile expelling apparatus 20 at a constant, non-rotating, entry point.

FIG. 6 shows another alternative embodiment of the projectile expelling apparatus 20 using a rotational arm 58 for expelling projectiles. To begin operating the projectile expelling apparatus 20, a projectile is fed into the fixed channel 24 and then enters the rotational channel 38. The rotational arm 58 rotates 360-degrees to pick-up the projectile and expel the projectile out the exit end 42 of the rotational channel To change the trajectory of the projectile, simply change the rotational position of the rotational channel 38 by rotating the rotational channel 38 in the rotational direction 54. When the rotational channel 38 is rotated, the fixed channel 24 remains stationary allowing projectiles to enter the projectile expelling apparatus 20 at a constant, non-rotating, entry point.

FIG. 7 shows another alternative embodiment of the projectile expelling apparatus 20 including a projectile dispensing mechanism 72 adjacently attached to the fixed channel 24. To begin operation, the user loads multiple projectiles into the projectile feeder 74. The projectiles then move down the projectile feeder 74 to stop at the gate 82. The automatic dispenser 76 includes a timing device 80 to dispense one projectile at a time past the gate 82, past the feeding end 78, and into the fixed channel 24. The projectile then enters the rotational channel 38, engages the projectile expelling mechanism 50 and is expelled from the rotational expelling housing.

To change the trajectory of the projectile, simply change the rotational position of the rotational channel 38 by rotating the rotational channel 38 in the rotational direction 54. When the rotational channel 38 is rotated, the fixed channel 24 and the projectile dispensing mechanism 72 remain stationary allowing the projectile dispensing mechanism 72 to remain operational for dispensing the next projectile.

FIG. 8 shows another alternative embodiment of the projectile expelling apparatus 20 including a projectile dispensing mechanism 72 fixedly attached to the fixed channel 24. To begin operation, the user loads multiple projectiles into the fixed channel 24. The projectiles then move down the fixed channel 24 to stop at the automatic dispenser 76. The automatic dispenser 76 rotates to dispense one projectile at a time into the fixed channel 24. The projectile then enters the rotational channel 38, engages the projectile expelling mechanism 50 and is expelled out the rotational expelling housing.

To change the trajectory of the projectile, simply change the rotational position of the rotational housing 36 by rotating in the rotational direction 54. When the rotational housing 38 is rotated, the fixed channel 24 remains stationary allowing the projectile dispensing mechanism 72 to remain operational for dispensing the next projectile.

FIG. 9 shows another alternative embodiment of the projectile expelling apparatus 20 including an automatic dispenser 76 fixedly attached to the rotational expelling housing 36. To begin operation, the user loads multiple projectiles into the fixed channel 24. The projectiles then move down the fixed channel 24, into the rotational channel 38, and stop at the automatic dispenser 76. The automatic dispenser 76 rotates to dispense one projectile at a time into the rotational channel 38. The projectile then engages the projectile expelling mechanism 50 and is expelled out the rotational expelling housing 36.

To change the trajectory of the projectile, simply change the rotational position of the rotational housing 36 by rotating in the rotational direction 54. When the rotational housing 38 is rotated, the fixed channel 24 remains static allowing projectiles to feed continuously into the rotational expelling housing 36 without adjusting the fixed channel 24.

FIG. 10 shows the rotational direction 54 of the rotational expelling housing 36 with an attached projectile dispelling mechanism 72. The user can vary projectile trajectory by rotating the rotational expelling housing 36 in a 360-degree rotational direction 54. By varying the rotational expelling housing 36 position, the spin direction on the projectile changes causing the projectile to go straight, rise, curve, drop, or project in other various trajectories. The projectile dispensing mechanism 72, the fixed channel 24, and the entire channel base 22 remain fixed while the rotational housing 36 is rotated to vary the projectile trajectory.

CONCLUSIONS, RAMIFICATIONS, AND SCOPE

Accordingly, it can be seen that the new projectile expelling apparatus provides, for the first time, a fixed channel for projectiles to enter the projectile expelling apparatus at the same predefined point every time. This fixed entry point allows projectile dispensing mechanisms, such as automatic ball feeders, to remain fixed and at the same workable operating angle when the rotational expelling housing is rotated to any position for adjusting projectile trajectory. Since the rotational expelling housing rotates around the fixed channel, the weight of the rotational expelling housing is supported by the channel base and not supported by the user when loosing the rotational locking mechanism. This new invention not only saves manufacturing costs by eliminating unnecessary parts, but also makes user operation safe, fast, easy, enjoyable and affordable.

Although the description above contains much specificity, this should not be construed as limiting the scope of the invention but as merely providing illustrations of some of the presently preferred embodiments of this invention. Various other embodiments and ramifications are possible within its scope. For example, the projectile expelling mechanism could incorporate at least one wheel and at least one pneumatic device to expel projectiles. The pivot and lock mechanism could be located on at least one of the legs of the channel base or at any other adjusting location. The rotational expelling housing could be fully enclosed or have the internal parts exposed.

Thus, the scope of the invention should be determined by the appended claims and their legal equivalents, rather than by the examples given.

I claim:

1. A projectile expelling apparatus, comprising:

at least one fixed channel having an open end and a mating end, the open end and the mating end allow projectiles to pass in and out of at least one of the fixed channels;

a rotational expelling housing comprising:

a rotational channel having an entry end and an exit end, the entry end and the exit end allow projectiles to pass in and out of the rotational channel, the rotational channel rotationally connects to at least one of the fixed channels allowing the rotational expelling housing to rotate while the fixed channel suspends the rotational channel; and at least one projectile expelling mechanism securely attached to the rotational expelling housing for expelling projectiles from said housing.

2. A projectile expelling apparatus, comprising:

at least one channel base, comprising:

at least one fixed channel having an open end and a mating end, the open end and the mating end allow projectiles to pass in and out of at least one of the fixed channels, at least one of the fixed channels has a hollow axis of rotation located approximately at the center of at least one of the fixed channels;

at least one channel support securely connected to at least one of the fixed channels for supporting at least one of the fixed channels in a stable position;

a rotational expelling housing, comprising:

a rotational channel having an entry end and a exit end, the entry end and the exit end allow projectiles to pass in and out of the rotational channel, the rotational channel has a void axis of rotation located approximately at the center of the rotational channel and aligns with the hollow axis of rotation of at least one of the fixed channels, at least one of the fixed channels and the rotational channel rotationally connect to create a concentric mating point for allowing projectiles to enter and exit at least one of the fixed channels and enter and exit the rotational channel when the rotational expelling housing is rotated to any position; and at least one projectile expelling mechanism attached to the rotational expelling housing for expelling projectiles from the rotational expelling housing.

3. A projectile expelling apparatus according to claim 2, wherein the mating end of at least one of the fixed channels is rotationally connected to the entry end of the rotational channel.

4. A projectile expelling apparatus according to claim 2, wherein the mating end of at least one of the fixed channels is rotationally connected to the exit end of the rotational channel.

5. A projectile expelling apparatus according to claim 2, wherein the mating end of at least one of the fixed channels is rotationally connected to the entry end of the rotational channel, and the mating end of another of at least one of the fixed channels is rotationally connected to the exit end of the rotational channel.

6. A projectile expelling apparatus according to claim 2, wherein the projectile expelling mechanism includes at least one wheel to expel projectiles.

7. A projectile expelling apparatus according to claim 2, wherein the projectile expelling mechanism includes at least one rotational arm to expel projectiles.

8. A projectile expelling apparatus according to claim 2, wherein the projectile expelling mechanism includes at least one pneumatic device to expel projectiles.

9. A projectile expelling apparatus according to claim 2, wherein at least one of the fixed channels is angled for allowing gravity to move projectiles along at least one of the fixed channels.

10. A projectile expelling apparatus according to claim 2, wherein the rotational channel is angled for allowing gravity to move projectiles along the rotational channel.

11. A projectile expelling apparatus according to claim 2, further comprising at least one rotational locking mechanism, the rotational locking mechanism connects to the channel base for temporarily locking the rotational position of the rotational expelling housing.

12. A projectile expelling apparatus according to claim 2, further comprising at least one channel adapter for maintaining the alignment of the hollow axis of rotation of at least one of the fixed channels and the void axis of rotation of the rotational channel, the channel adapter concentrically aligns at least one of the fixed channels and the rotational channel.

13. A projectile expelling apparatus according to claim 2, further comprising a pivot and lock mechanism connected to the channel base, the pivot and lock mechanism pivots and secures the rotational expelling housing in an up and down position to vary projectile travel height.

14. A projectile expelling apparatus according to claim 2, further comprising a projectile dispensing mechanism adjacently located to at least one of the fixed channels, the projectile dispensing mechanism includes a projectile feeder and an automatic dispenser, the projectile feeder feeds projectiles into the automatic dispenser and the automatic dispenser dispenses projectiles into at least one of the fixed channels.

15. A projectile expelling apparatus according to claim 2, wherein the fixed channel further includes an automatic dispenser, the automatic dispenser dispenses projectiles from the fixed channel into the rotational channel.

16. A projectile expelling apparatus according to claim 2, wherein the rotational expelling housing further includes an automatic dispenser, the automatic dispenser dispenses projectiles into the rotational expelling housing.

17. The method for assembling a projectile expelling apparatus, said apparatus having a fixed channel and a rotational housing comprising the steps of:

creating at least one fixed channel by forming an open end and a mating end, the open end and the mating end allow projectiles to pass in and out of at least one of the fixed channels;

creating a rotational expelling housing by:

fabricating a rotational channel including an entry end and an exit end, the entry end and the exit end allow projectiles to pass in and out of the rotational channel;

connecting the rotational channel to at least one of the fixed channels for suspending the rotational channel from at least one of the fixed channels, and for creating a concentric mating point for allowing projectiles to enter and exit at least one of the fixed channels and enter and exit the rotational channel when the rotational expelling housing is rotated to any position;

fabricating at least one projectile expelling mechanism for expelling projectiles from the rotational expelling housing; and securely attaching at least one of the projectile expelling mechanisms to the rotational expelling housing.

18. The method of assembly of claim 17, further comprising the step of fabricating at least one channel support for supporting at least one of the fixed channels in a stable position, and connecting at least one of the channel supports securely to at least one of the fixed channels.

19. The method of assembly of claim 17, further comprising the step of fabricating a rotational locking mechanism for temporarily locking the rotational position of the rotational expelling housing, and connecting the rotational locking mechanism to the channel base.

20. The method of assembly of claim 17, further comprising the step of fabricating a pivot and lock mechanism to pivot and secure the projecting end of the rotational expelling housing in an up and down position allowing projectile travel height to vary, and connecting the pivot and lock mechanism to the channel base.

21. The method of assembly of claim 17, further comprising the steps of creating a projectile dispensing mechanism by fabricating an automatic dispenser to dispense projectiles automatically; fabricating a projectile feeder to feed projectiles into the automatic dispenser, connecting the automatic dispenser to the projectile feeder; and locating the projectile dispensing mechanism adjacent to at least one of the fixed channels.

* * * * *